US005634225A

United States Patent [19]

Miller, Sr. et al.

[11] Patent Number: 5,634,225

[45] Date of Patent: Jun. 3, 1997

[54] MODULAR AIR BED

[75] Inventors: Craig S. Miller, Sr., Yorba Linda; Craig S. Miller, Jr., Corona, both of Calif.

[73] Assignee: Foamex L.P., Linwood, Pa.

[21] Appl. No.: 450,524

[22] Filed: May 25, 1995

[51] Int. Cl.[6] ..... A47C 27/10

[52] U.S. Cl. ..... 5/710; 5/713

[58] Field of Search ..... 5/453, 455, 449, 5/456, 914, 710, 713

[56] References Cited

U.S. PATENT DOCUMENTS

| | | | |
|---|---|---|---|
| 4,525,885 | 7/1985 | Hunt et al. | 5/453 |
| 4,745,647 | 5/1988 | Goodwin | 5/453 |
| 4,944,060 | 7/1990 | Perry et al. | 5/453 |
| 4,947,500 | 8/1990 | Seiler | 5/453 |
| 5,090,077 | 2/1992 | Caden et al. | 5/455 |
| 5,121,513 | 6/1992 | Thomas et al. | 5/453 |
| 5,235,713 | 8/1993 | Guthrie et al. | 5/453 |
| 5,267,364 | 12/1993 | Volk | 5/453 |

*Primary Examiner*—Alexander Grosz
*Attorney, Agent, or Firm*—Nathan Epstein

[57] ABSTRACT

An air support unit for use in a modular air support bed has a common base pad of pliable material and inflatable elements releaseably fastened to one side of the base pad to define a body support surface. The air support unit constitutes a lightweight, foldable module easily and quickly interchangeable in a given bed with other modules having different patient support characteristics. The air support unit may be contained in a coverlet having a detachable top for easy access to the air support unit. An interior frame of resilient foam may be provided around the air support unit inside the coverlet for enhanced edge support.

7 Claims, 4 Drawing Sheets

MODULAR AIR BED

BACKGROUND OF THE INVENTION

1. Field of the Invention

This invention pertains generally to the field of inflatable mattresses and more particularly is directed to an air support bed of modular construction featuring a removable air support unit in a bed structure. Air support units having different body support characteristics can be readily exchanged to adapt a particular bed to changing requirements.

2. State of the Prior Art

Air support beds are in widespread use in medical care settings, particularly for patients requiring long term bed care. Bed ridden patients are susceptible to skin ulcerations caused by excessive buildup of heat and moisture on the skin, typically in combination with pressure, friction and shear forces exerted on the skin by contact with the bed surface, which tend to close off capillary blood circulation in skin tissues. Such ulcerations are painful and slow to heal, and are a frequent complication in bed ridden individuals. Air mattresses and air support beds have been found to alleviate this problem because the air filled chambers of the bed tend to conform to the anatomy of the bed ridden patient better than ordinary mattresses and consequently distribute pressure over a wider area of skin, thereby diminishing the risk and severity of skin ulcerations. Furthermore, the firmness of an air mattress can be controlled and adjusted simply by increasing or diminishing the internal air pressure, and air support beds featuring positive pressure regulation by means of electronically controlled air pumps have been developed. Air mattresses with compartmentalized air chambers which can be individually pressurized to different degrees are used for creating different zones of varying firmness adapted to the requirements of different anatomical areas of the patient's anatomy.

The requirements of long term medical bed care has led to the development of four principal classes of air beds.

Static pressure air beds are kept inflated to a preset pressure by an air blower or air pump.

Computerized or positive pressure control air beds feature one or more air pressure sensors connected to an electronic control system which actuates an air pump and an air relief valve, supplying or venting compressed air as needed to hold the internal pressure of the air chambers of the bed at a preset level, compensating as the user shift positions or gets in and out of the bed.

Cyclic pressure air beds alternately inflate and deflate different air chambers of the bed mattress so as to periodically shift pressure between different areas of the user's anatomy. The cyclic action of the air bed tends to stimulate the affected tissues and provides an opportunity for blood circulation to re-establish itself in those areas.

Low loss air beds have air chambers with finely perforated walls which allow pressurized air to leak continuously from the air chambers at a controlled rate into the bed cavity containing the air support unit. The continuous airflow under the patient carries away excess moisture and prevents heat buildup, which as earlier mentioned are among the principal causes of skin tissue breakdown in bed ridden patients.

Each of these categories of air beds has its particular advantages, and one type may be preferred over the others depending on a combination of medical benefit and economic considerations. There are substantial cost differences between beds in the different categories, so that the more elaborate units may be reserved for those patients in greatest need of this type of support.

Existing medical air support beds are constructed to provide a specific type of support. Consequently, an inventory of the different types of air beds must be kept on hand in order to anticipate the needs of the patient population of a medical institution. If the existing inventory is inadequate to meet the needs of the moment the result may be an inability to provide optimum bed support for some patients. Since patient loads and requirements fluctuate constantly medical institutions may need to keep a large and costly inventory of different types of air beds.

What is needed is an air bed which can be readily adapted to provide different types of support as may be required by particular patients without need for replacement of the entire bed. The conversion should be relatively quick and simple with only minimal training of available personnel. Furthermore, the ability to exchange support characteristics of the air bed should not greatly add to the cost or complexity of the bed.

SUMMARY OF THE INVENTION

The aforementioned need is addressed by the present invention which provides a modular air mattress for use on a bed, such as a conventional hospital bed.

In a presently preferred form of the invention the air mattress has an air support insert contained in an insert cavity defined by an interior frame of the mattress. The air support insert has a number of air inflatable elements each of which is secured to a common base pad. The inflatable elements substantially fill the insert cavity and support the weight of a patient's body placed on the air support unit. The inflatable elements are interconnected by an air hose manifold which is connected to an air supply and control system adapted to regulate the internal air pressure in the inflatable elements according to criteria chosen to minimize risk of skin ulcerations in a patient using the bed. A coverlet of textile fabric or other pliable sheet material encloses both the internal frame and the air support insert. The coverlet consists of a coverlet bottom having a bottom panel and a side panel permanently joined to the bottom panel and a removable top cover, together forming a closely fitting envelope about the frame and the air support unit. The top cover is releasably fastened to the side panel, as by a zipper along the upper edge of the side panel, to allow access to the air support insert in the central cavity.

The air mattress of this invention is characterized by an air support unit which is removable and replaceable as a unit, so that a given hospital bed for example can be readily adapted to the needs of a given patient simply by exchanging the air support unit in the mattress. The modular construction of the air mattress minimizes the bed components which must be changed to meet the user's needs, making bed support tailored to changing patient requirements easier and more economical.

The air support unit or module includes the base pad carrying the attached inflatable elements and the air hose manifold. The air support unit is removable from and insertable into the central cavity of the interior frame as a complete assembly, allowing rapid and relatively easy exchange of different air support assemblies having different therapeutic characteristics, all without changing the rest of the bed.

In an alternate form of the invention the air support unit is contained only by the coverlet without a frame around the support unit. In such embodiment the air support unit in the coverlet serves as an air mattress which is installed on an existing bed.

The invention extends to an air support system where the air mattress is as described above and including two or more air support assemblies having different body support or therapeutic characteristics, each of the air support assemblies being installable in and removable from the mattress as a unit, so that the support characteristics of the air bed may be readily altered simply by exchanging air support units in the mattress.

Each of the inflatable elements in the air support assembly has first fastener elements which are releasably engageable to corresponding second fastener elements on the base pad, such that each inflatable element can be individually separated from the base pad. The fastener elements may be mechanical snap release fasteners. The interior frame may be of relatively stiff synthetic foam with a fabric covering adhesively attached to the foam, and provides lateral support for the inflatable elements and also positive support for the patient along the edges of the mattress. The base pad may be a pliable pad of resilient foam covered with sheeting of synthetic material, of rectangular shape and closely encompassed by the interior frame. The inflatable elements may be tubular and arranged parallel to each other in a row extending from head to foot along the longitudinal dimension of the air support unit, each tube extending the width of the base pad. The air hose manifold connecting the inflatable elements to the air supply can be entirely contained between the interior frame the air support assembly.

The air supply including the air pump and control system are preferably integrated into the interior frame of the air mattress, for example, in a cavity or recess defined in the interior frame, thereby eliminating exposed air hoses between the bed and a separate air supply. In one form of the air support unit the air hose manifold is connected to the air supply system by an air inlet hose, an air outlet hose and a pressure sensor hose, with the air supply system operating to maintain all the inflatable elements at a substantially equal air pressure. In another form of the air support unit two or more air hose manifolds are each in fluidic communication with a corresponding sub-set of the inflatable elements. The air supply system is connected to the air hose manifolds and is controlled in such manner as to alternately, cyclically inflate and deflate the elements of each subset thereby periodically shifting pressure to different portions of the user's anatomy.

These and other advantages, features and improvement of the present invention will be better understood by reference to the following detailed description of the preferred embodiment taken in conjunction with the accompanying drawings.

DETAILED DESCRIPTION OF THE PREFERRED EMBODIMENT

Figure 1:
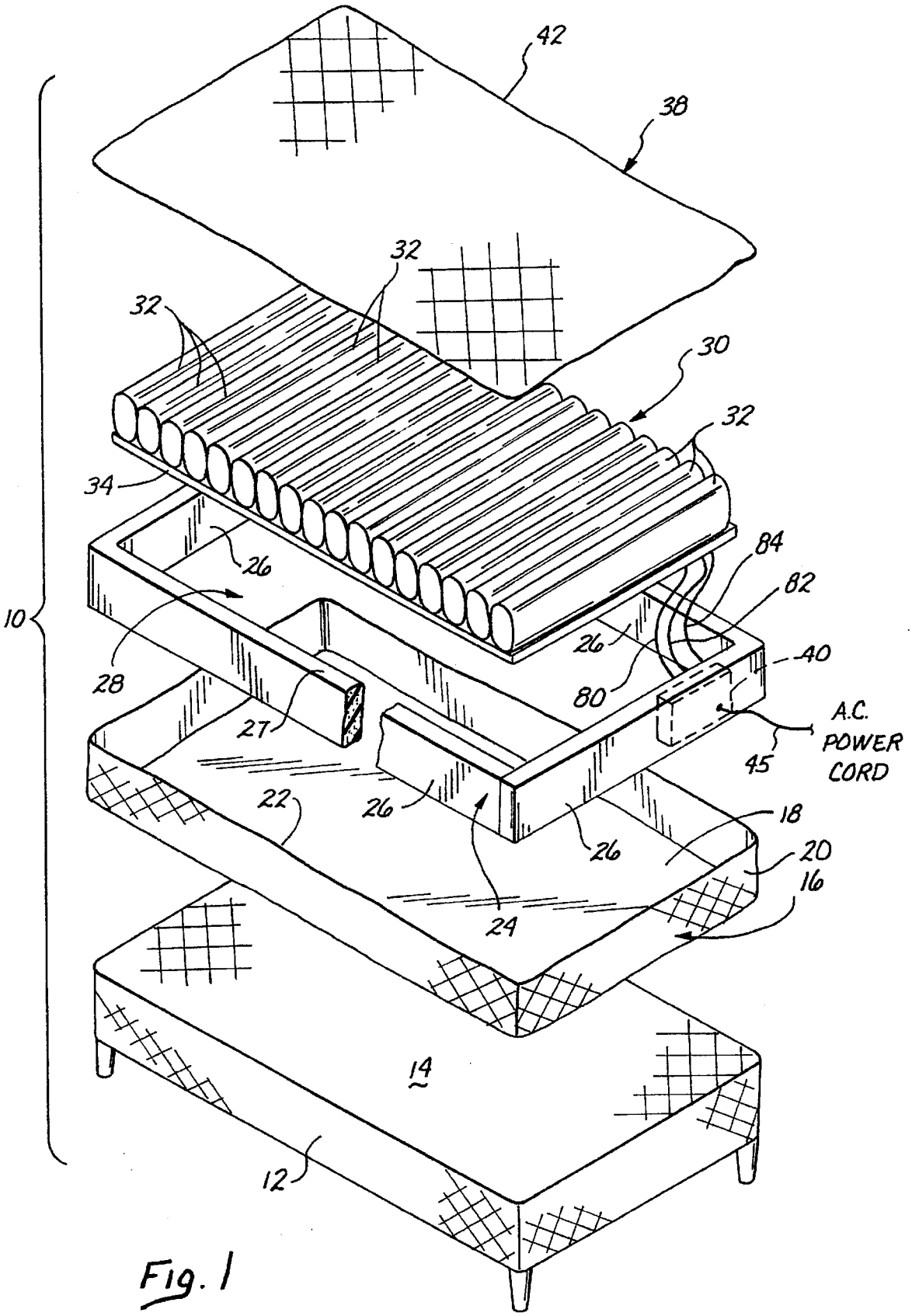
FIG. 1 is an exploded perspective view of an air support bed featuring an air mattress according to this invention.

With reference to the drawings, FIG. 1 illustrates the main components of a modular air support bed according to this invention. A bed base 12 stands on an underlying ground or floor surface and provides a mattress supporting surface 14. A coverlet bottom 16 of textile fabric has a rectangular bottom panel 18 sown to a side panel 20 which extends upwardly from all four edges of the bottom panel 18 defining a relatively shallow tray structure.

An interior frame 24 has four side beams 26 of relatively stiff but resilient synthetic foam, each of generally rectangular cross-section and joined at their ends to define a an elongated rectangular center cavity 28.

An air support unit 30 has a rectangular base pad 34 sized to fit inside the central cavity and made of a relatively thin pad of synthetic foam covered with impermeable plastic sheeting such as vinyl sheet. The base pad has a longitudinal dimension and a width somewhat undersized to the corresponding dimensions of the center cavity 28, and of sufficient size to comfortably accommodate the body of a person. The base pad 34 serves as a common carrier for a row of inflatable air tubes 32 arranged in mutually parallel relationship along the longitudinal dimension of the base pad. The air tubes 32 are made of thin vinyl or urethane sheet material with radio-frequency welded seams. Each of the air tubes has an oval or rectangular cross section, as best seen in side in view of FIGS. 5 and 5*a* and the base pad 34 has a thickness which is much smaller than the diameter of the inflatable air tubes 32 as measured in a direction perpendicular to the base pad.

Figure 2:
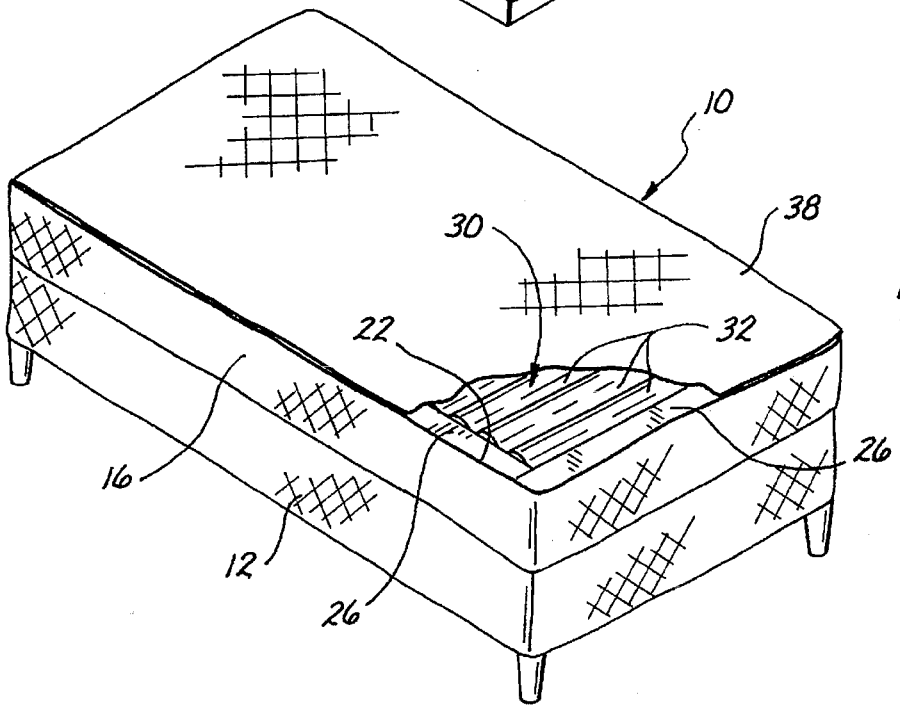
FIG. 2 shows the bed of FIG. 1 in assembled condition with the coverlet partially broken away to expose the air support unit.

The frame 24 fits snugly in the coverlet bottom 16. The air support unit makes a close fit in the central cavity 28 and the air tubes 32 span the width of the base pad so that the opposite ends of each air tube 32, and the length of the end tubes in the row, are laterally supported by the interior frame 24. The upper surfaces of the air tubes together define a support surface 36 which is approximately level with the top 27 of the interior frame. A cover 38 has a rectangular edge 42 provided with a zipper half which attaches to a corresponding zipper half along the upper edge 22 of the coverlet bottom 16. When zipped together the coverlet bottom 16 and cover 38 form a box-shaped enclosure which contains the interior frame 24 and the air support unit 30. The coverlet bottom panel 18 provides a common bottom for the interior frame and the air support unit 30, while the side panel 20 provides lateral support on all four sides for the beams 26 of the interior frame, preventing the frame from excessively bulging outwardly when the air support unit 30 is loaded with the body weight of a bed occupant. FIG. 2 shows the air bed of FIG. 1 in assembled condition, with the cover 38 attached to the coverlet bottom 16. The assembled air mattress is normally fitted with conventional bed sheets, pillows and the like in preparation for use.

Figure 1A:
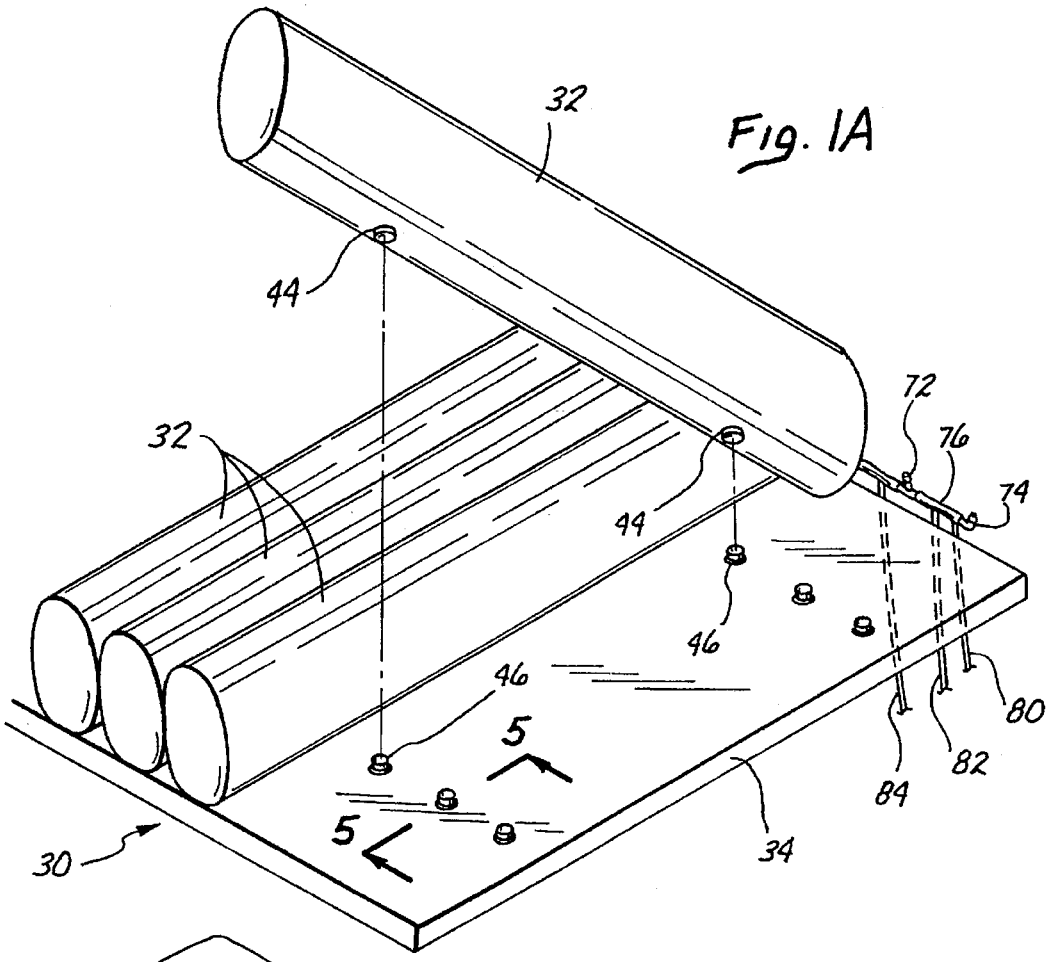
FIG. 1*a* is a fragmentary view of the air support unit illustrating the manner of attachment of the inflatable air tubes to the common base pad.
Figure 5A:
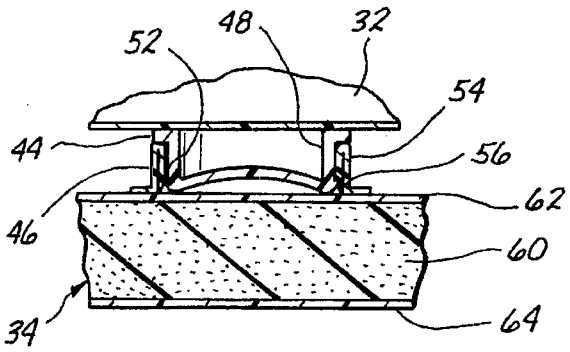
FIG. 5*a* is a view as in FIG. 5, showing the fastener elements in assembled relationship.
Figure 5:
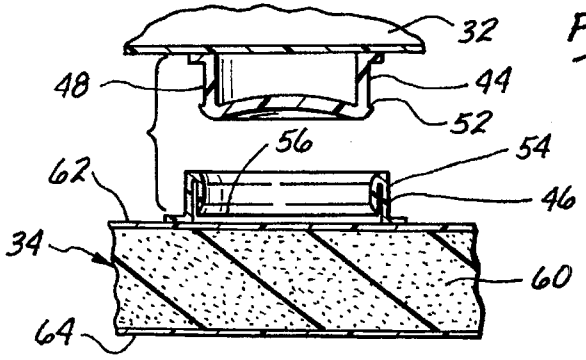
FIG. 5 is a sectional view of the mating fastener elements of an air tube and the base pad, shown prior to mutual engagement, taken along line 5—5 in FIG. 1*a;*

FIG. 1*a* shows how the individual inflatable air tubes 32 are releasably attached to the common base pad 34. Each air tube 32 has a pair of male fasteners 44 spaced apart along the tube, each of which mates with a corresponding female fastener 46 mounted on the base pad 34 to make a snap release mechanical interlock, as shown in the sequence of FIGS. 5—5*a*. The male fastener 44 has a cylindrical wall 48 with an annular shoulder 52. The female fastener 46 also has a cylindrical outer wall 54 and an annular inner flange which terminates at a lower edge 56. When the male fastener element 44 is pressed into the female fastener element 46, the elements deform slightly to admit the enlarged diameter of the shoulder 52 through the reduced inside diameter of the inner flange. When the shoulder 52 clears the lower edge 56, the elements return to their normal configuration such that the lower edge 56 makes interlocking engagement with the shoulder 52, as shown in FIG. 5*a*, to retain the two fastener elements 44, 46 in interlocking relationship. The two fastener elements can be separated by pulling the two elements apart with sufficient force to again slightly deform the elements to cause disengagement of the shoulder 52 from the female fastener element. Each of the air tubes 32 is secured in this fashion to the common base pad 34. The fastener elements 44, 46 are of flexible plastic material and are adapted for this purpose from commercially available air valves sold for use in the air bed and water bed industry. The commercial valves are sold with the male and female elements joined by a flexible integral linkage which is severed for purposes of this invention. However, other fasteners may be used and the air mattress disclosed here is not limited to any particular means of attachment of the air tubes 32 to the base pad 34.

As also shown in FIGS. 5—5*a*, the base pad has an inner thickness of resilient synthetic foam 60 which extends the full length and width of the pad 34, to provide a degree of cushioning additional to that provided by the inflatable tubes 32. The foam 60 is covered with upper and lower outer sheets 62, 64, joined to each other along the four edges of the pad and made of a durable and impermeable material such as vinyl or urethane sheet material.

Figure 3:
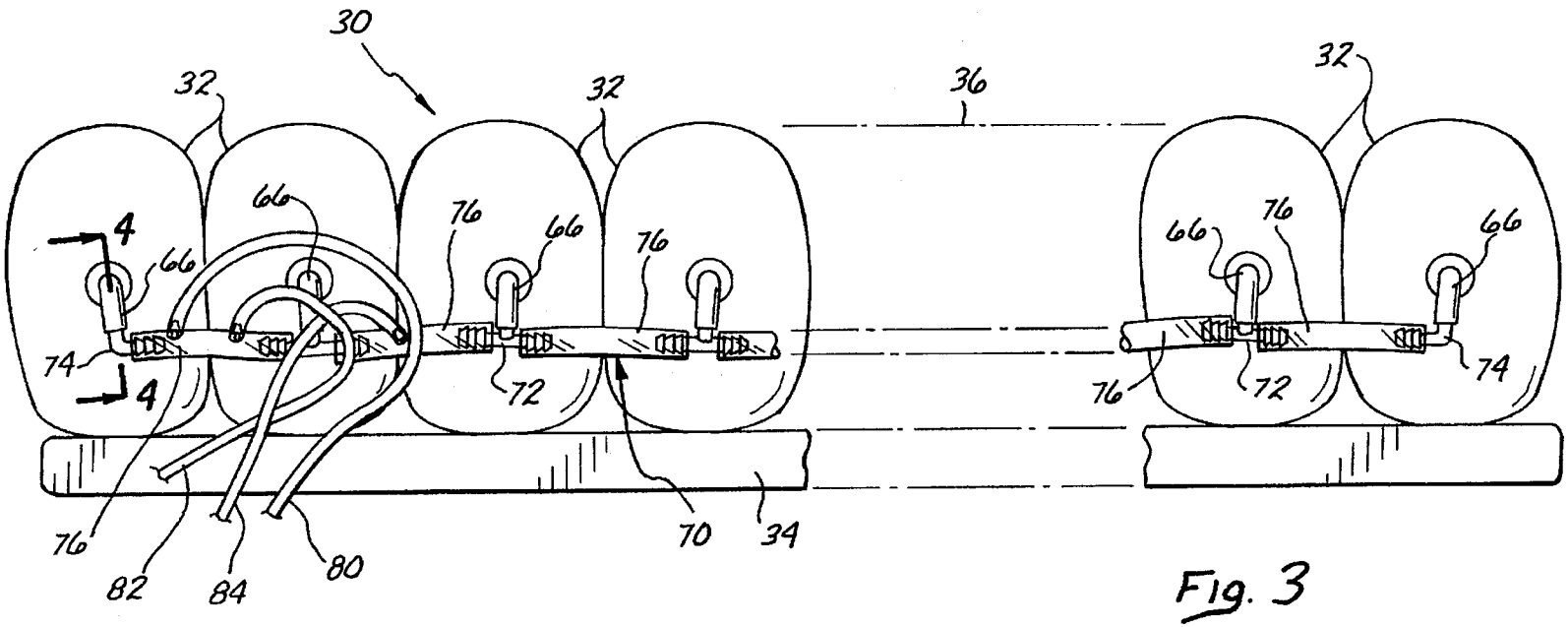
FIG. 3 is a side view of a modular static pressure air support unit according to this invention.
Figure 4:
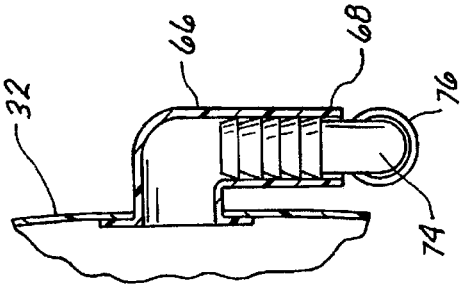
FIG. 4 is a section of an elbow air inlet at the end of an air tube taken along line 4—4 in FIG. 3.

The air tubes 32 are interconnected in fluidic communication by an air hose manifold 70. FIG. 3 illustrates the air hose manifold for a so-called static pressure air support unit, where a desired uniform air pressured is maintained in all the air tubes 32. Each air tube 32 has an elbow shaped air inlet tube 66 which opens to the interior of the air tube and has an outer end 68. A relatively large diameter manifold 70 common to all the air tubes 32 is established by T connectors 72 and L shaped connector 74 fitted into the inlet tubes 66, and interconnected by hose segments 76. Three smaller diameter air conduits connect to the manifold 70, namely, an air inlet line 80, an air outlet line 82 and a pressure sensor line 84. These three lines 80, 82, 84 are connected to a pressurized air supply and pressure regulating system 40. The air supply and pressure regulating system may be of conventional design with a small electrically operated air pump, an electrically actuated air vent valve and an electronic control system typically assembled on one circuit board. The air inlet line 80 is connected to the high pressure outlet of the air pump which delivers compressed ambient air to the inlet line 80. The outlet line 82 is connected to the vent valve which is normally closed but can be momentarily opened by the control system in order to release pressurized air from the inflatable tubes 32. The pressure sensor line 84 is connected to a pressure sensor which delivers a control voltage output related to the internal pressure of the inflatable tubes 32. A suitable control system compares the output of the pressure sensor, representative of air pressure sensed at the sensor line 84, to a control signal representative of a desired air pressure in the tubes 32. If the sensed pressure is below the desired pressure, the control system actuates the pump to increase the pressure in the air tubes. If on the contrary the sensed pressure is above the desired pressure, the vent valve is open by the control system to release pressure until the sensed and desired pressures are equalized.

Figure 3A:
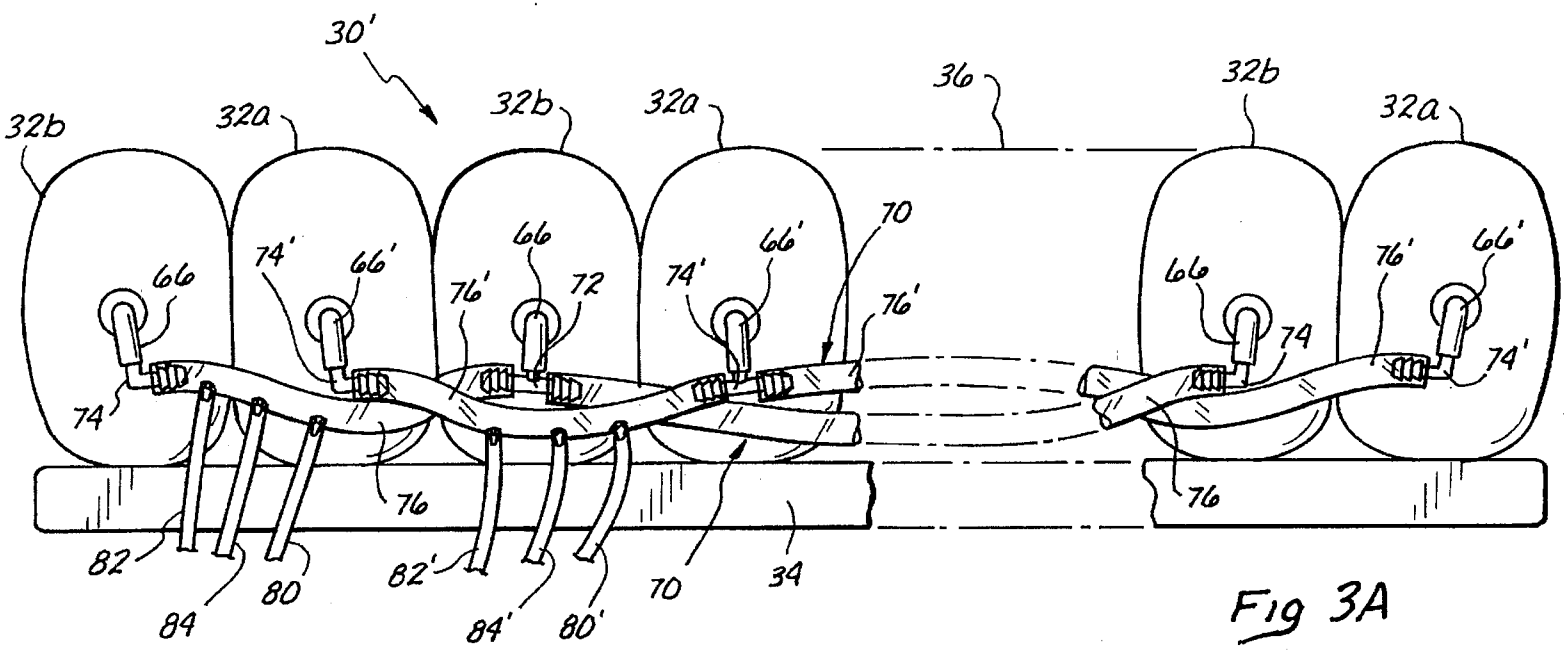
FIG. 3*a* is a side view of a modular cyclic pressure air support unit according to this invention.

FIG. 3*a* shows a cyclic pressure type air support unit 30' where the row of inflatable air tubes includes two sets of air tubes **32*a* and 32*b* which alternate with each other along the common base pad 34. The air tubes of each set are interconnected with each other by separate air hose manifolds 70 and 70' respectively. Each manifold is connected to an air supply and regulation system by air tubes 80, 82, 84 and 80', 82', 84'**. The primed and unprimed numerals in FIG. 3*a* serve the same function as the corresponding numerals in FIG. 3. The manifolds 70, 70' are connected to the air supply and regulation systems through an electrically operated four-way valve such that compressed air is supplied to one set of tubes **32*a* or 32*b***, while the other set of tubes is slowly depressurized through the electrically operated vent valve. The manifold connections are then automatically reversed by actuation of the four-way valve so that the more highly pressurized set of air tubes is bled of air while the previously depressurized tubes are inflated. This pattern is repeated cyclically so that the pressure exerted by the air support unit against the users' body periodically shifts.

It will be appreciated that the entire air support unit 30 can be easily and quickly removed from the interior frame 24 as a single unit without disconnecting the individual tubes 32 from the air tube manifold 70 or disassembling the air tubes 32 from the base pad 34. Another air support unit can then be installed, essentially by dropping it into the central cavity 28 and connecting the air manifold of the new air support unit to the air supply system 40. Access to the central cavity and the air support unit is achieved by simply unzipping the cover 38 from the coverlet bottom 16. Once a replacement support unit 30 is installed, the cover 38 is replaced by zipping to the coverlet bottom 16. The entire operation can be accomplished by minimally skilled personnel.

The entire air supply and control unit 40, operating as described in connection with either FIG. 3 or 3*a*, is housed in a recess or cavity defined in a side beam 26 of the interior frame 24, and only requires connection to an A.C. power outlet by means of A.C. power cord 45. The air supply and regulation unit 40 is preferably mounted so as to be readily removable from its niche cavity in the interior frame 24 as a different air support unit may require a different air supply and regulation system.

The air support unit 30 can be removed from the bed 10 without significant loss of air pressure in the inflatable tubes 32. The small diameter tubes 80, 82, 84 may be each disconnected from the air supply 40 and capped or plugged without substantial loss of air. Likewise, a fully inflated air support unit can be just as easily installed in the bed 10.

For storage, the air support unit 30 may be fully deflated so that the air tubes 32 are collapsed and the base pad 34 can be folded or rolled to a relatively compact package which can be conveniently carried by one person and does not require much space for storage.

In a modified embodiment of the invention, the air support unit 30 may be contained in the coverlet 16, 38 without the interior frame 24. In such case the coverlet bottom 16 is dimensioned such that the side panel 20 closely contains and provides lateral support for the air tubes 32 at the ends of the tubes and also along the length of each end tube of the row of air tubes. That is, the coverlet is sized to fit closely about all sides of the air support unit 30. In this modified embodiment the air support unit 30 is removable as a unit together with the air hose manifold from the coverlet and replaceable with another air support unit which may be of different therapeutic effect, as may be needed to meet current clinical requirements. The air pump and air control unit 40 of the FIG. 1 embodiment may be housed in a unit separate from the air bed and connected to the air manifold of the air support unit by air conduits 80, 82, 84 as described earlier in connection with FIGS. 1, 1A, 3, 3A.

While certain preferred embodiments of the invention have been described and illustrated for purposes of clarity and example, it must be understood that many changes, substitutions, and modifications to the described embodiments will become obvious to those possessed of ordinary skill in the art without thereby departing from the scope and spirit of the present invention which is defined by the following claims.

What is claimed is:

1. An air support unit for use in a modular air support bed, comprising:

a rectangular base pad having an interior pad of synthetic foam covered with sheeting of synthetic material, said base pad having a width and a longitudinal dimension between opposite ends;

a plurality of individually inflatable tubes of thin synthetic material;

first fastener means on each of said tubes engageable to, second fastener means on one side of said base pad for releasably securing said tubes in closely adjacent mutually parallel relationship in a row extending from one to another of said opposite ends and said tubes extending approximately the full said width of said base pad; and means for interconnecting said tubes to a supply of pressurized air for inflating said tubes;

wherein said first and said second fastener means are made of resiliently deformable plastic material radio-frequency welded respectively to outer surfaces of said inflatable tubes and of said sheeting of said base pad;

said base pad having a thickness much smaller than a diameter of said inflatable elements such that said pad with said inflatable elements fastened thereon can be folded or rolled to a compact condition for storage or transport.

2. The air support of claim 1 wherein said inflatable elements are arranged in closely adjacent mutually parallel relationship on said base pad, each of said inflatable elements has a bottom, and second fasteners attached to said bottom in spaced relationship along a longitudinal dimension of said inflatable elements, said second fasteners being releaseably engageable to said first fasteners for securing each of said inflatable elements to said base pad.

3. The air support unit of claim 1 wherein said means for interconnecting comprise an air supply hose, an air outlet hose and a pressure sensor hose, each said hose connected by air conduit means to said inflatable tubes.

4. A modular air support mattress comprising:

an air support module having a common base pad of pliable material having an upper side and a lower side, a plurality of individually inflatable elements, each said element individually fastened to said upper side of said base pad, air hose means for connecting said inflatable elements to a supply of pressurized air for inflating said elements; and a coverlet enclosing said module, said coverlet having a coverlet bottom and a top cover removably attached to said coverlet bottom;

said air support module being readily removable from said coverlet and accessible upon detachment of said top cover from said coverlet bottom, said base pad having a thickness much smaller than a diameter of said inflatable elements such that said pad with said inflatable elements fastened thereon can be folded or rolled to a compact condition for storage or transport.

5. The air support mattress of claim 4 further comprising an interior frame contained in said coverlet and defining a central cavity, said module being contained in said central cavity.

6. The air support mattress of claim 5 wherein said interior frame is made of synthetic foam.

7. An air support unit for use in a modular air support bed, comprising:

a rectangular base pad having an interior pad of synthetic foam covered with sheeting of synthetic material, said base pad having a width and a longitudinal dimension between opposite ends;

a plurality of individually inflatable tubes of thin synthetic material;

first fastener means on each of said tubes engageable to second fastener means on one side of said base pad for releasably securing said tubes in closely adjacent mutually parallel relationship in a row extending from one to another of said opposite ends and said tubes extending approximately the full said width of said base pad;

air hose means defining manifold means external to said inflatable tubes and interconnecting said tubes, and means for connecting said manifold means to a supply of pressurized air for inflating said tubes;

an interior frame of synthetic foam removable from said coverlet, said frame defining a central cavity, said base pad with said inflatable tubes being contained in said central cavity;

a coverlet closely fitted to and enclosing said frame and said module, said coverlet having a bottom, sides and a top cover removable for gaining access to said module;

said base pad with said inflatable tubes secured thereto being readily removable from said central cavity, said base pad being configured and dimensioned to allow said pad with said inflatable tubes secured thereto to be folded rolled to a relatively compact package to thereby facilitate the carrying thereof.

* * * * *